US009425538B2

(12) United States Patent
Wu et al.

(10) Patent No.: US 9,425,538 B2
(45) Date of Patent: Aug. 23, 2016

(54) CABLE CONNECTOR ASSEMBLY WITH A SNAP RING

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Xiao Fan, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/884,743

(22) Filed: Oct. 15, 2015

(65) Prior Publication Data

US 2016/0111807 A1 Apr. 21, 2016

(30) Foreign Application Priority Data

Oct. 16, 2014 (CN) ..... 2014 1 0545888

(51) Int. Cl.

| | |
|---|---|
| ***H01R 13/40*** | (2006.01) |
| ***H01R 13/506*** | (2006.01) |
| ***H01R 13/52*** | (2006.01) |
| ***H01R 43/16*** | (2006.01) |
| ***H01R 13/6581*** | (2011.01) |

(52) U.S. Cl.

CPC ..... *H01R 13/506* (2013.01); *H01R 13/5202* (2013.01); *H01R 13/6581* (2013.01); *H01R 43/16* (2013.01)

(58) Field of Classification Search

CPC ..... H01R 13/52; H01R 13/5202; H01R 13/5205; H01R 13/5221

USPC ..... 439/587, 750, 589, 686

See application file for complete search history.

(56) References Cited

U.S. PATENT DOCUMENTS

| | | | | | |
|---|---|---|---|---|---|
| 2,076,072 | A * | 4/1937 | Douglas | H01R 13/582 | 403/209 |
| 2,131,066 | A * | 9/1938 | Obermaier | H01R 13/5219 | 136/235 |
| 2,639,313 | A * | 5/1953 | Street, Jr. | H01F 27/04 | 174/152 R |
| 3,646,496 | A * | 2/1972 | Williams | H01R 13/65802 | 174/75 C |
| 3,904,812 | A * | 9/1975 | Daffron | H05K 5/0039 | 174/549 |
| 3,954,319 | A * | 5/1976 | Haines | H01R 13/28 | 439/294 |
| 4,758,174 | A * | 7/1988 | Michaels | H01R 13/5219 | 439/281 |
| 5,470,248 | A * | 11/1995 | Wood | H01R 13/523 | 439/271 |
| 7,993,159 | B2 * | 8/2011 | Chawgo | H01R 9/0524 | 439/584 |
| 2012/0178290 | A1 * | 7/2012 | Yu | H01R 13/5202 | 439/587 |

FOREIGN PATENT DOCUMENTS

| | | |
|---|---|---|
| CN | 201690055 | 12/2010 |

* cited by examiner

*Primary Examiner* — Phuong Dinh

(74) *Attorney, Agent, or Firm* — Ming Chieh Chang; Wei Te Chung

(57) ABSTRACT

A cable connector assembly includes an insulative housing having a main portion extending along a mating direction and a connecting portion extending rearwards from the main portion, a tubular contact received in the insulative housing, a cable electrically connected to the tubular contact, a cover assembled to the connecting portion of the insulative housing via the thread, and a snap ring enclosing an outside of a connecting area between the cover and the insulative housing.

7 Claims, 8 Drawing Sheets

CABLE CONNECTOR ASSEMBLY WITH A SNAP RING

BACKGROUND OF THE INVENTION

1. Field of the Invention

The present invention relates to a cable connector assembly, and more particularly relates to a snap ring for establishing a connection between an insulative housing and a cover.

2. Description of Related Art

China Patent No. 201690055, issued on Dec. 29, 2010, discloses a cable connector assembly comprising an insulative housing, a tubular contact received in the insulative housing, a cover mounted to the insulative housing, and a cable electrically connected with the tubular contact. The insulative housing comprises a main portion extending along a mating direction and a connecting portion extending rearwardly from the main portion. The connecting portion defines an exterior thread on an external surface thereof. The cover is made of thermoplastic rubber material and defines an internal thread on an interior surface thereof. The cover is connected to the connecting portion of the insulative housing via the thread. However, the thermoplastic material is subject to aging as time goes on. So the cover may become loose and disengage from the connecting portion of the insulative housing.

Hence, an improved cable connector assembly is required to overcome the above-mentioned disadvantages of the related art.

BRIEF SUMMARY OF THE INVENTION

Accordingly, an object of the present invention is to provide a cable connector assembly having a snap ring to prevent the cover loosing.

In order to achieve the above-mentioned object, a cable connector assembly includes: an insulative housing comprising a main portion extending along a mating direction and a connecting portion extending rearwards from the main portion, a tubular contact received in the insulative housing, a cable electrically connected to the tubular contact, a cover assembled to the connecting portion of the insulative housing via the thread, and a snap ring enclosing an outside of a connecting area between the cover and the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
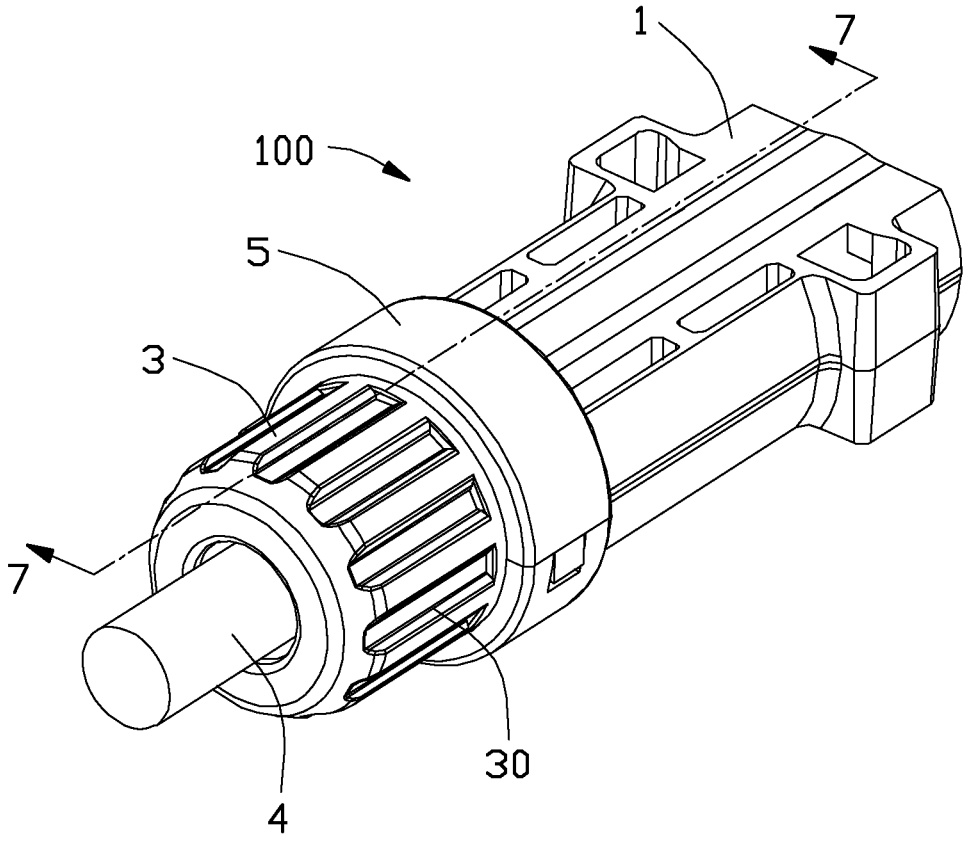
FIG. 1 is a perspective view of a cable connector assembly according to the present invention.
Figure 2:
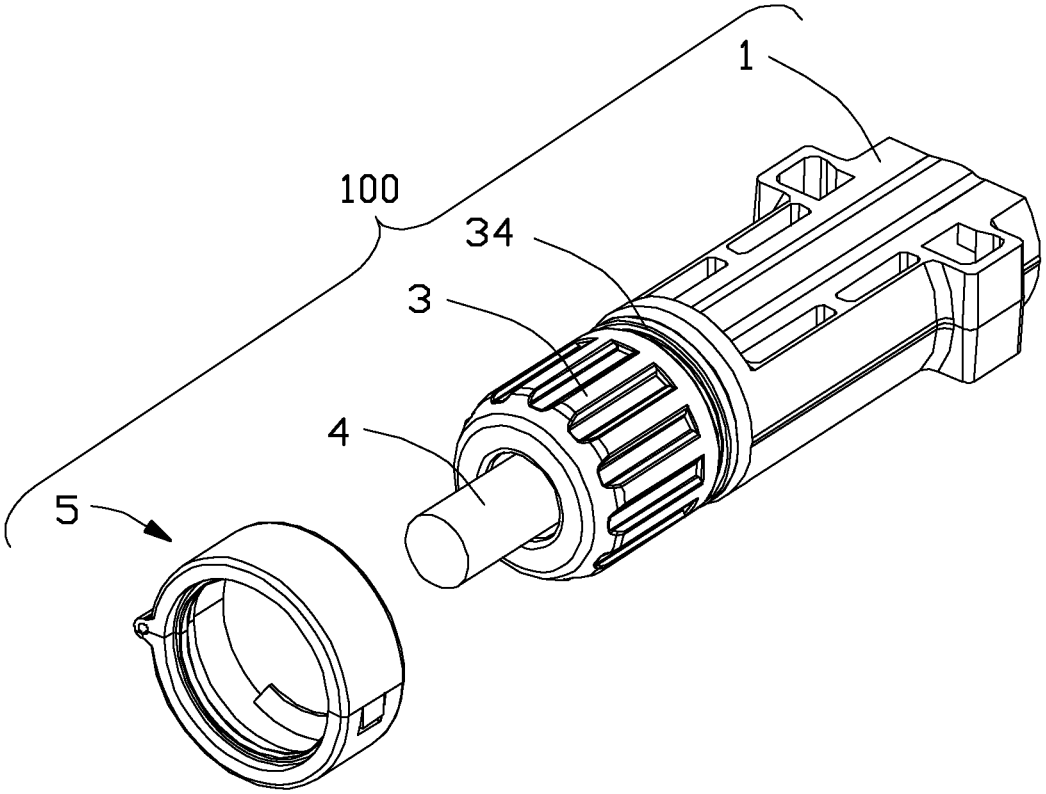
FIG. 2 is a partly exploded view of the cable connector assembly as shown in FIG. 1.
Figure 3:
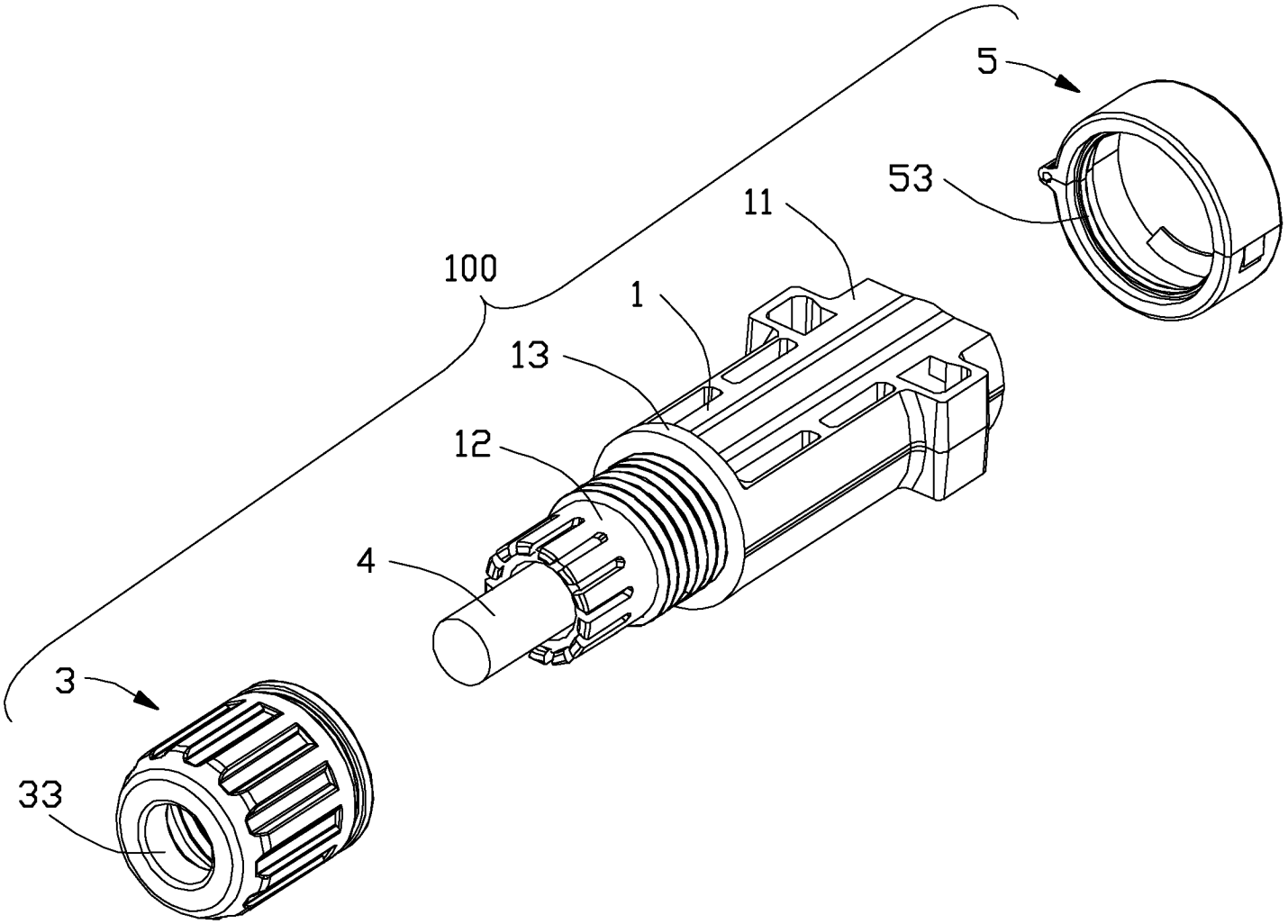
FIG. 3 is a further exploded view of the cable connector assembly as shown in FIG. 1.
Figure 4:
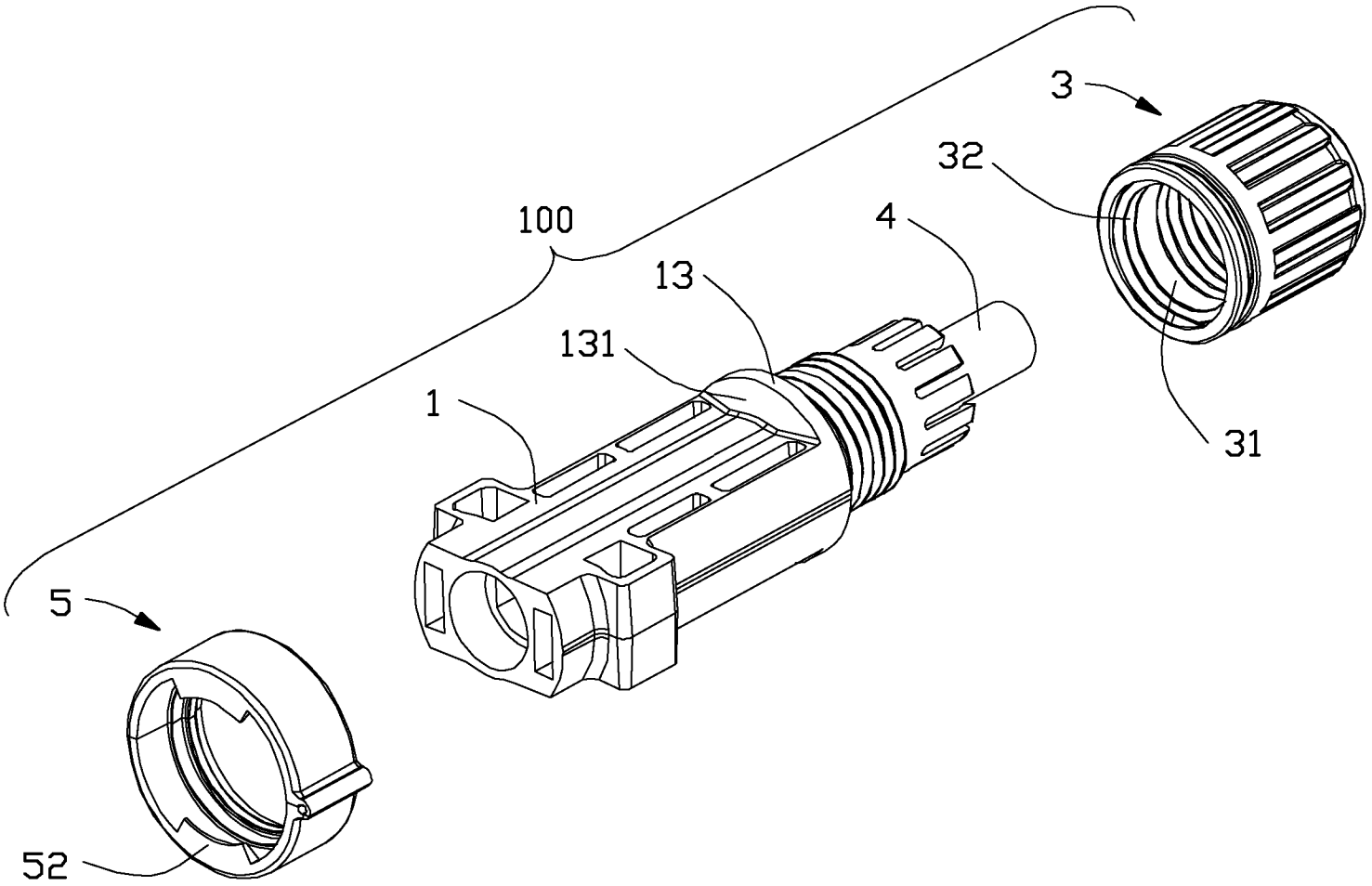
FIG. 4 is an exploded view of the cable connector assembly as shown in FIG. 3 from another aspect.
Figure 5:
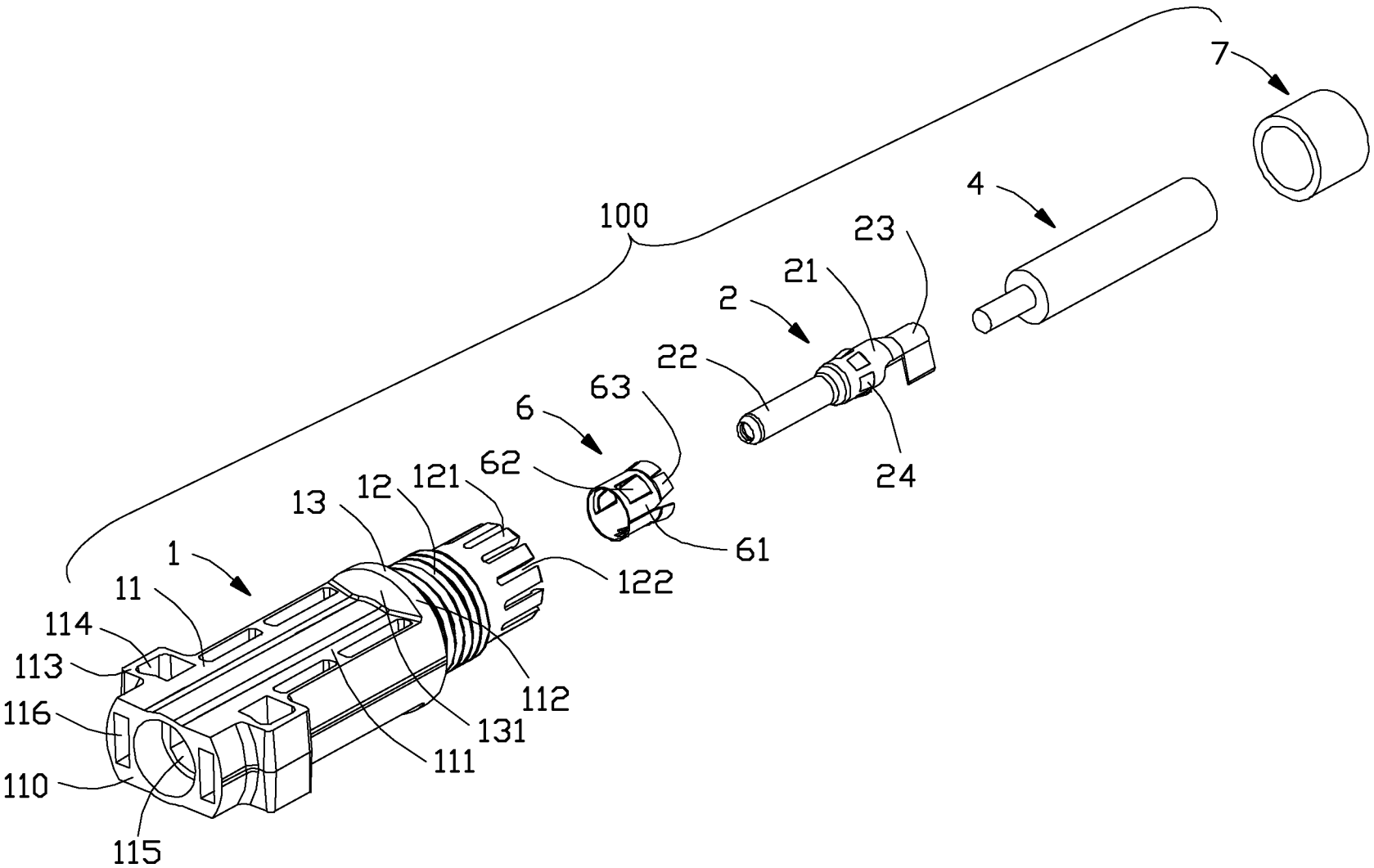
FIG. 5 is an exploded view of the cable connector assembly as shown in FIG. 1; but removed the cover and the snap ring.
Figure 6:
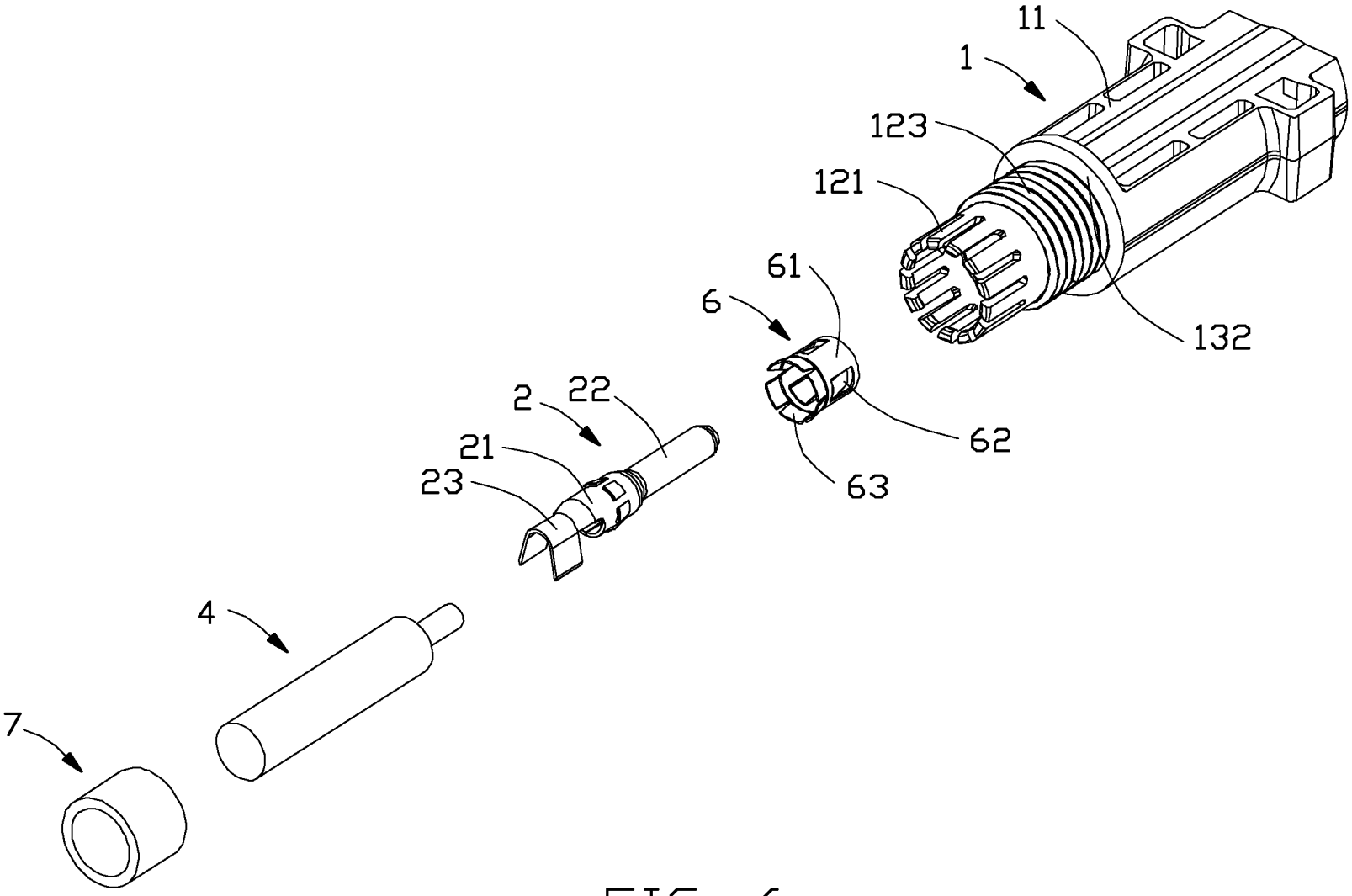
FIG. 6 is an exploded view of the cable connector assembly as shown in FIG. 5 from another aspect.
Figure 7:
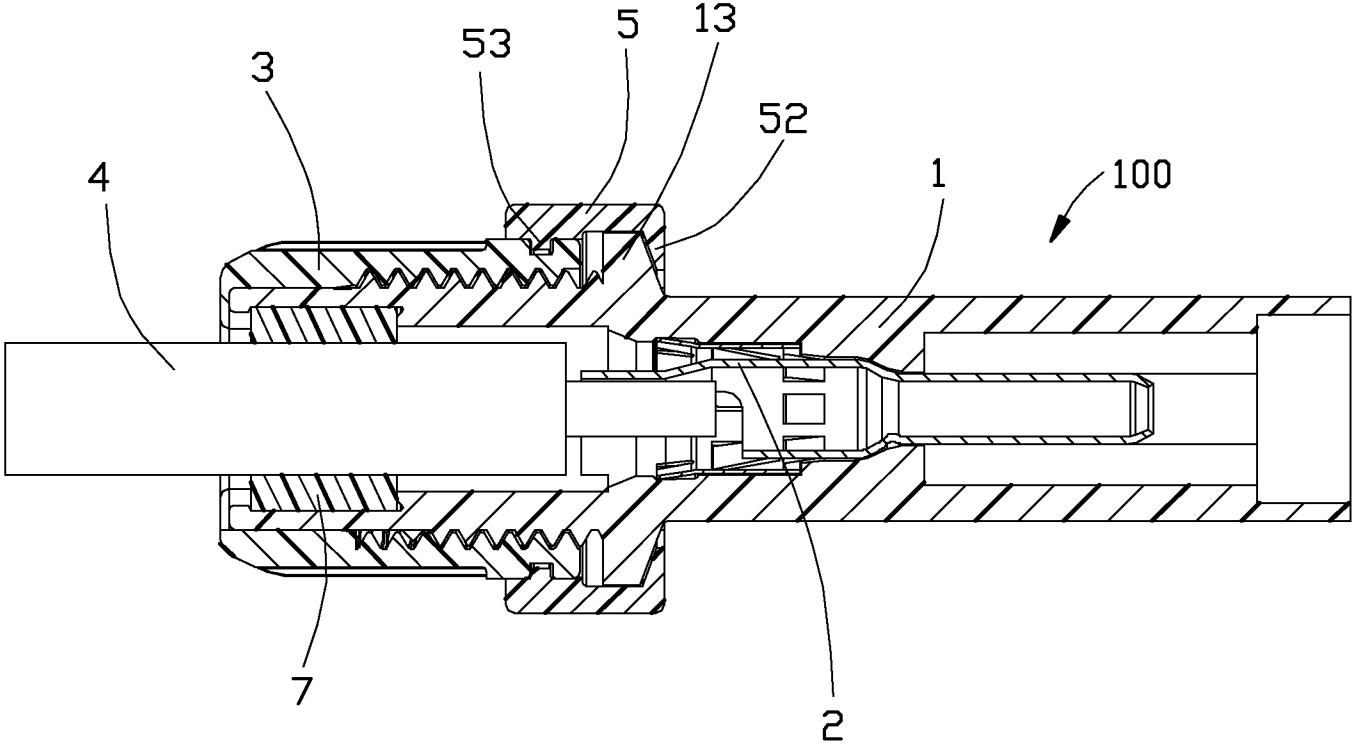
FIG. 7 is a partly cross section view of the cable connector assembly taken along line 7-7 in FIG. 1 from another aspect.
Figure 8:
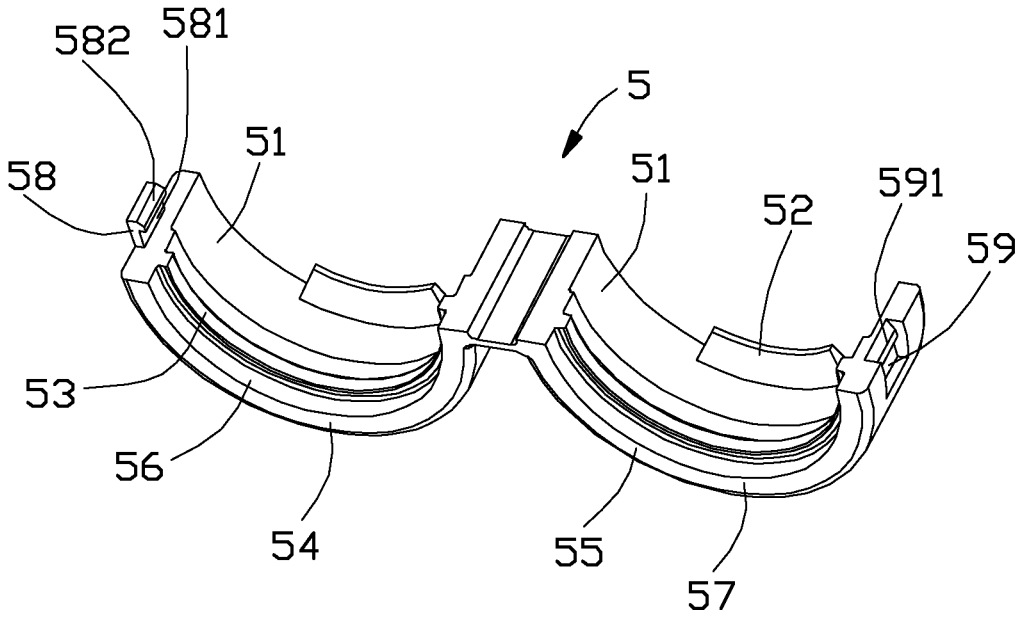
FIG. 8 is a perspective view of a snap ring according to the present invention.

Referring to FIGS. 1 through 8, a cable connector assembly 100 in accordance with the present invention for mating with a complementary connector (not shown) comprises an insulative housing 1, a tubular contact 2 accommodated in the insulative housing 1, a metal ring 6 disposed at an outside of the tubular contact 2, a cover or screw cap 3 assembled to a rear end of the insulative housing 1, a cable 4 electrically connected with the tubular contact 2 and a snap or holding ring 5 enclosing an outside of a connecting area of the cover 3 and the insulative housing 1.

The insulative housing 1 comprises a main portion 11 extending along a mating direction, a connecting portion 12 extending rearwards from the main portion 11, and a flange/boundary portion 13 disposed between the main portion 11 and the connecting portion 12 along a front-to-back or axial direction. A diameter of the flange portion 13 is larger than a diameter of the connecting portion 12.

The main portion 11 has a front end face 110. A pair of projecting portions 113 are symmetrical formed two sides of the main portion 11, and approach to the front end face 110 of the insulative housing 1. Each of the projecting portions 113 has a receiving hole 114. The receiving hole 114 is penetrated the projecting portion 113 in a direction vertical to the mating direction. A hollow circular cavity 115 is formed at a center of the main portion 11 and depressed along the mating direction. The main portion 11 has a pair of rectangular slots 116 depressed rearwards from the front end face 110 of the main portion 11. The pair of slots 116 are symmetry disposed in the left and right sides of the cavity 115 and disposed in the front end of the projecting portion 113. The pair of slots 116 and the corresponding receiving hole 114 are intercommunicating.

The connecting portion 12 comprises plural spring tabs 121 spaced apart from each other in a circumferential direction to form a shrinkable region. A plurality of indentations 122 are formed between the adjacent spring tabs 121 so as to have such spring tabs 121 form a radially shrinkable region. A circular space is surrounded by the spring tabs 121. The flange portion 13 has a first side 131 approaching to the main portion 11 and an opposing second side 132 approaching to the connecting portion 12. The connecting portion 12 has an external thread 123 on an exterior surface thereof to form a thread region. The external thread 123 is disposed at a front end of the spring tabs 121 to form a thread region and approaching to the second side 132 of the flange portion 13. The cover 3 has an internal thread 31 on an interior surface thereof. The cover 3 is rotated and retained in the connecting portion 12 via the external thread 123 matching with the internal thread 31.

The tubular contact 2 is made of metallic material. The tubular contact 2 comprises a base portion 21, a columnar contact portion 22 extending forwardly from the base portion 21 and a tail portion 23 located at a rear end of the base portion 21. An outer diameter of the contact portion 22 is smaller than an outer diameter of the base portion 21. The base portion 21 defines a plurality of clamping portions 24 protruding outwards from an external surface to cooperate with the metal ring 6. A front end of the clamping portion 24 is connected with the external surface of the base portion 21, and a rear end of the clamping portion 24 slightly open toward the outside.

The metal ring 6 is cooperate with the tubular contact 2 to prevent the tubular contact 2 moving. The metal ring 6 comprises a front end portion 61 designed as a hollow cylindrical shape and plural lugs 63 connected to the front end portion 61. The front end portion 61 has a plurality of holding pieces 62 bending inwardly.

The cable connector assembly 100 comprises a seal ring 7 surrounded the cable 4. The seal ring 7 is inserted into the connecting portion 12 of the insulative housing 1 along an axial direction.

The cover 3 comprises a first opening 32, a second opening 33 disposed at an end of the first opening 32 for the cable 4 passing through. The first opening 32 is communicated with the second opening 33 in a front-to-back direction. An inner diameter of the first opening 32 is larger than an inner diameter of the second opening 33. The cover 3 comprises a plurality of grooves 30 spaced apart from each other on a surface thereof for increasing the friction force and an annular recess 34 depressed in a circumference direction and formed in a front section thereof.

The snap ring 5 has an inner wall 51. The inner wall 51 has a protruding portion 52 engaged with the first side 131 of the flange portion 13 and a rib 53 cooperated with the annular recess 34. Therefore, the cable connector assembly 100 can achieve waterproof and dustproof and increase its service life by the snap ring 5 establishing a tight fit between the insulative housing 1 and the cover 3. The snap ring 5 has a larger inner diameter than an outer diameter of the flange portion 13. The snap ring 5 consists of a first body 54 designed as a semicircular shape and a second body 55 designed as a semicircular shape that are connected together. The first body 54 has a first circular arc portion 56 and a latching arm 58 extending forwardly from the first circular arc portion 56. The second body 55 has a second circular arc portion 57 and a notch 59 on a front end thereof to be mated with the latching arm 58 of the first body 54. An end of the first body 54 is connected with an end of the second body 55. The first body 54 and the second body 55 can be combined together. The latching arm 58 comprises an extending portion 581 and a locking block 582 projecting from a free end of the extending portion 581. The notch 59 defines a tuber 591 engaged with the locking block 582 to complete a closed state of the snap ring 5.

In assembling of the cable connector assembly 100, the metal ring 6 is assembled to the tubular contact 2 firstly, then the tubular contact 2 accommodated in the insulative housing 1. The contact portion of the tubular contact 2 is received in the cavity 115 and the tail portion 23 of the tubular contact 2 is electrically connected with the cable. The seal ring 7 is inserted into the circular space surrounded by the spring tabs 121 and surrounded the cable 4. The cover 3 can rotate in the connecting portion 12 of the insulative housing 1 to squeeze the spring tabs 121, thus filling the space between the spring tabs 121 and the cable 4 by seal ring 7. The cover 3 is rotated and retained in the connecting portion 12 via the thread. Because the cover 3 is made of thermoplastic rubber material, it is apt to deform or become loose after a long time of use. By provision of the snap ring 5, the outermost/front edge of the cover 3 may be radially shielded and protected. Notably, in this embodiment, the outermost/front edge of the cover 3 is also protected/shielded by the flange portion 13 along the axial direction.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing comprising a main portion extending along a mating direction and a connecting portion extending rearwards from the main portion;

a tubular contact received in the insulative housing;

a cable electrically connected to the tubular contact;

a cover assembled to the connecting portion of the insulative housing via a thread; and a snap ring enclosing an outside of a connecting area between the cover and the insulative housing, wherein the cover comprises an annular recess depressed in a circumference direction and located in a front section thereof, and the snap ring comprises an inner wall defining a rib protruding outwards from an internal surface to cooperate with the annular recess, wherein the insulative housing comprises a flange portion disposed between the main portion and the connecting portion, and the flange portion comprises a first side close to the main portion, the inner wall of the snap ring defining a protruding portion engaged with the first side of the flange portion, wherein the snap ring comprising a first body designed as a semicircular-shaped and a second body designed as a semicircular-shaped, an end of the first body being connected with an end of the second body, the first body and the second body can rotate around the connection so that the first body and the second body being combined together, wherein the first body comprises a first circular arc portion and a latching arm extending forwardly from the first circular arc portion, the second body comprising a second circular arc portion and a notch on a front end thereof to be matched with the latching arm of the first body.

2. The cable connector assembly as recited in claim 1, wherein the latching arm comprises an extending portion and a locking block projected from a free end of the extending portion, the notch comprising a tuber engaging with the locking block to make the snap ring show a closed state.

3. The cable connector assembly as recited in claim 1, further comprising a seal ring inserted into the connecting portion along an axial direction and surrounded the cable.

4. The cable connector assembly as recited in claim 3, wherein the connecting portion comprises plural spring tabs spaced apart from each other in a circumferential direction, the cover rotated and surrounded on the connecting portion of the insulative housing to squeeze the spring tabs, and filling a space between the spring tabs and the cable via the seal ring.

5. The cable connector assembly as recited in claim 1, wherein an inner diameter of the snap ring is at least larger than an outer diameter of the flange portion.

6. A cable connector assembly comprising:

a tubular housing including a front main portion and rear connecting portion in an axial direction, the connecting portion including a thread region and a radially shrinkable region along said axial direction;

a contact disposed in the main portion;

a cable connected to and located behind the contact;

a screw cap mounted upon the connecting portion and engaged with the thread region to compress the shrinkable region against the cable; and a holding ring detachably mounted upon the screw cap and a portion of the housing to shield and protect engagement between the screw cap and the thread region, wherein said holding ring includes means for prohibiting relative movements between the holding ring and the screw cap, and between the holding ring and the housing along the axial direction, wherein a portion of said holding ring is located radially around the thread region, wherein said portion of the housing is a boundary portion located between the main portion and the connecting portion in said front-to-back direction, wherein said portion is a flange portion extending radially so as to confront said screw cap along said axial direction, wherein said holding ring has two parts pivotally assembled to each other to form an opening for snapping upon the screw cap and the portion, wherein a sealing ring is located between the shrinkable region and the cable radially, wherein the main body is closer to said thread region than to the shrinkable region along said axial direction.

7. A method of making a cable connector assembly, comprising steps of:

providing an insulative tubular housing with a front main portion and a rear connecting portion along an axial direction, said connecting portion including a thread region and a radially shrinkable region along said axial direction;

assembling a contact in the housing;

locating a cable in the connecting region to be connected to the contact;

screwing a screw cap upon the thread region to radially compress the shrinkable region against the cable; and mounting a holding ring upon the screw cap and a portion of the housing to shield an outermost edge of the screw cap radially, wherein said portion is a radially extending flange portion to confront the screw cap in the axial direction for protecting engagement between the screw cap and the thread region, further including a step of providing means to having said holding ring immovable relative to both said screw cap and said housing in said axial direction, wherein said holding ring has two parts pivotally assembled to each other to form an opening for snapping upon the screw cap and the portion, wherein a sealing ring is located between the shrinkable region and the cable radially, wherein the main body is closer to said thread region than to the shrinkable region along said axial direction.

* * * * *